US006190231B1

(12) United States Patent
Hoberman

(10) Patent No.: US 6,190,231 B1
(45) Date of Patent: Feb. 20, 2001

(54) CONTINUOUSLY ROTATING MECHANISMS

(76) Inventor: Charles Hoberman, 472 Greenwich St., New York, NY (US) 10013

( * ) Notice: Under 35 U.S.C. 154(b), the term of this patent shall be extended for 0 days.

(21) Appl. No.: 09/366,831

(22) Filed: Aug. 4, 1999

Related U.S. Application Data

(60) Provisional application No. 60/111,001, filed on Dec. 4, 1998.

(51) Int. Cl.[7] ..... A63H 33/00

(52) U.S. Cl. ..... 446/487; 446/104; 446/108

(58) Field of Search ..... 446/85, 102, 104, 446/108, 128, 487, 488, 489; 428/12

(56) References Cited

U.S. PATENT DOCUMENTS

D. 169,878 * 6/1953 Washington ..... 446/487
2,576,439 * 11/1951 Beck et al. ..... 446/487
3,815,280 * 6/1974 Gilfillan ..... 446/487
3,977,683 * 8/1976 Tomura ..... 446/487
4,591,152 * 5/1986 Ellwein ..... 446/85
5,209,693 * 5/1993 Lyman ..... 446/128
5,234,367 * 8/1993 Decesare ..... 446/487

* cited by examiner

*Primary Examiner*—Sam Rimell
(74) *Attorney, Agent, or Firm*—Lieberman & Nowak, LLP

(57) ABSTRACT

This application is directed to a linkage system which provides continuous rotation to two or more interconnected quadrilaterals. The basic element of the linkage system is a multi-level link which provides firstly, a non-rotatable connection between two sub-links lying, in separate parallel planes and secondly, a rotatable connection for a further link lying in another parallel plane between the planes of the sub-links. By various interconnections between link elements, the quadrilaterals the linkage system will form various geometric patterns as the linkage is rotated. As the quadrilaterals lie in different planes, they may be continuously rotated with respect to each other. The linkage system may be used as a toy, a novelty item and as an educational tool.

17 Claims, 6 Drawing Sheets

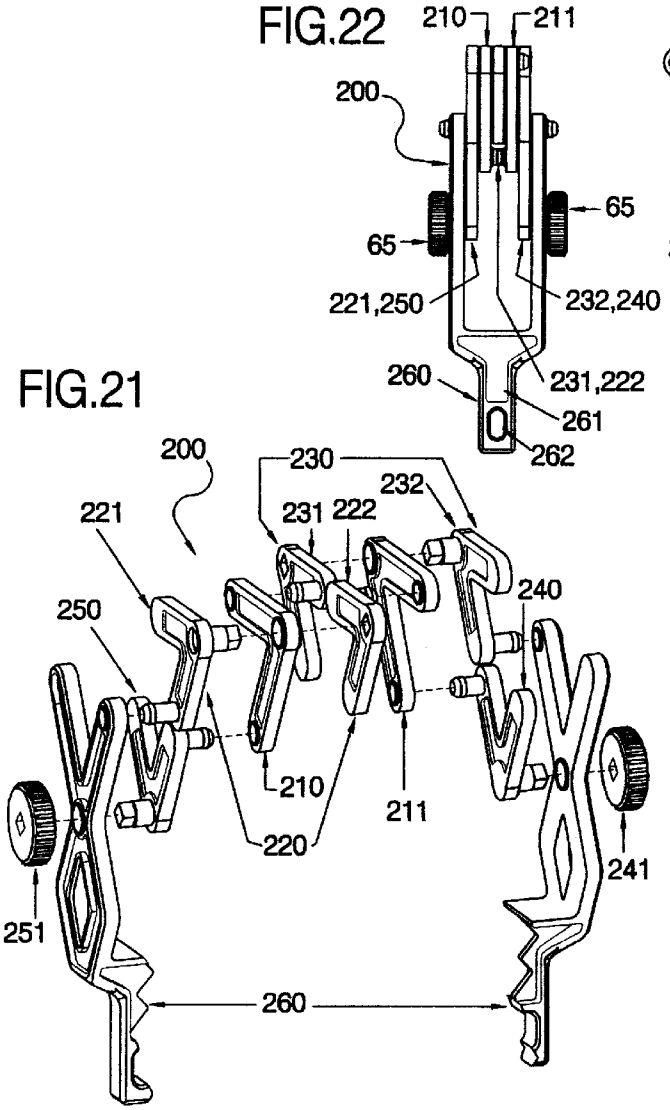
FIG.21
FIG.22
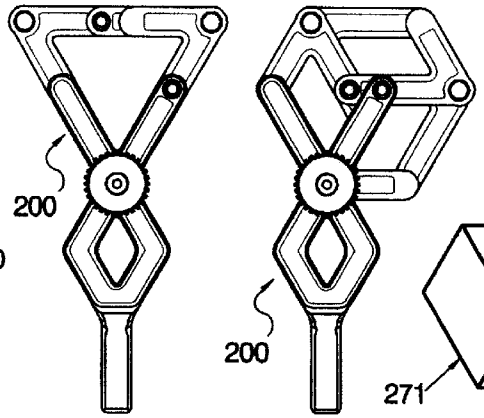
FIG.23
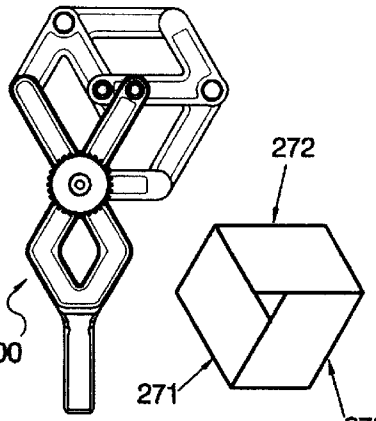
FIG.24
FIG.25
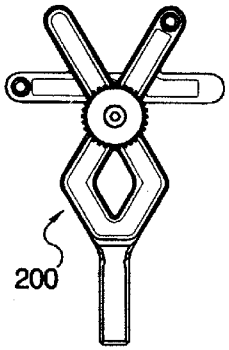
FIG.26
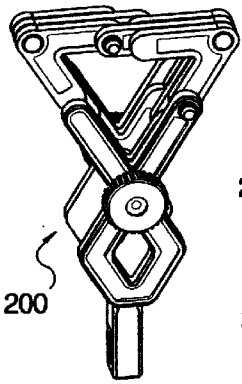
FIG.27
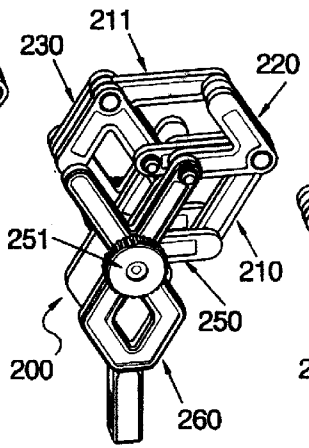
FIG.28
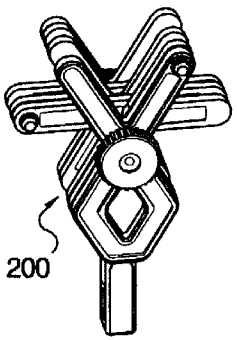
FIG.29

300

392
394

391
393

300

300
312,321
311,380
340
350
331,322
370,332
360
390

300
330
360
390
380
320
350
310
340
300

300

300

363
391
361
362
330
332
393
370
331
360
320
350
322
321
312
340
310
380
311
390
300

400

400

400

400

410
460
440
430
420
450
400

400

413,423,433
450
460
411,421,431
440
412,422,432
400
423
426
427
424
425
422
421
420

420

470
423
433
413
420
422
450
412
432
410
421
440
430
460
411
431
400

CONTINUOUSLY ROTATING MECHANISMS

REFERENCE TO RELATED APPLICATIONS

This application claims the filing date of Provisional Patent Application No. 60/111,001 filed Dec. 4, 1998.

BACKGROUND OF THE INVENTION

The invention disclosed is a unique type of linkage that is comprised of a multiplicity of links lying on different levels. These links form a chain or a matrix of interconnected four-bar linkages. I have discovered a novel arrangement of connections that allow the links in such a linkage to rotate continuously relative to one another, rather than having rotational limits.

When driven, such a linkage moves smoothly and synchronously, the links moving past one another on different levels. The patterns formed by the links as they change their configuration are surprising and aesthetically pleasing.

Such linkages are useful as toys or novelty items. The linkages can function as interactive educational tools, using the changing geometric patterns to reveal mathematical relationships. Other uses may include vehicles for rough terrain, where the linkage forms a unique tread that can move over rough surfaces.

Different types of linkage systems are found in the structures described in my prior U.S. patents, including U.S. Pat. No. 4,942,700, issued Jul. 24, 1990, entitled Reversibly Expandable Doubly-Curved Truss Structure; U.S. Pat. No. 4,780,344, issued Oct. 25, 1988, entitled Reversibly Expandable Three-Dimensional Structure; U.S. Pat. No. 4,981,732, issued Jan. 1, 1991, entitled Reversibly Expandable Structures; U.S. Pat. No. 5,234,727, issued Aug. 10, 1993, entitled Curved Pleated Sheet Structure; and U.S. Pat. No. 5,024,031, issued Jun. 18, 1991, entitled Radial Expansion/Retraction Truss Structure.

BRIEF DESCRIPTION OF THE DRAWINGS

For a better understanding of the invention, reference is made to the following drawings which are to be taken in conjunction with the detailed description to follow:

FIG. 21 shows an exploded view of a third embodiment of the invention having one link that spans the full thickness of the linkage;

FIG. 22 shows a side view of the linkage of FIG. 21;

FIGS. 23–26 show front views of the linkage of FIG. 21 in different positions;

FIGS. 27–29 show perspective views of the linkage in different positions;

DETAILED DESCRIPTION OF THE PREFERRED EMBODIMENTS

Figure 2:
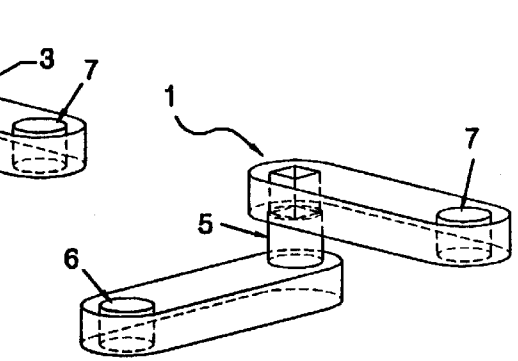
FIGS. 1–2 show a basic element of the invention, a multi-level link.
Figure 1:
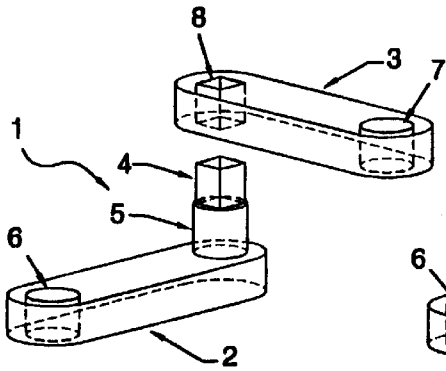

Shown in FIG. 1 is an exploded view of a link 1 that is made up of two sub-links 2 and 3. Sub-link 2 has a pivot 6 on one end, and a second pivot 5 on its other end. Attached to pivot 5 is an element 4 that provides means to make a rigid (non-rotatable) connection to sub-link 3. Sub-link 3 has a pivot 7 on one end and a cavity 8 which engages with element 4. In FIG. 2 sub-links 2 and 3 are shown rigidly attached together. It is seen that link 1 lies within two distinct planes and has a central pivot 5 that remains exposed between sub-links 2 and 3. Link 1 and others of its general type are thus hereinafter referred to as multi-level links. Pivots 6 and 7 lie at the extremities of link 1 and are hereinafter referred to as terminal pivots.

Figure 3:
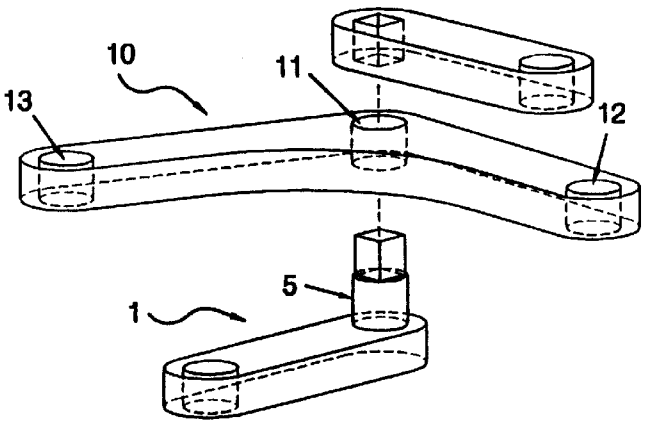
FIGS. 3–5 show a multi-level link assembled with another basic element, a planar link.
Figure 4:
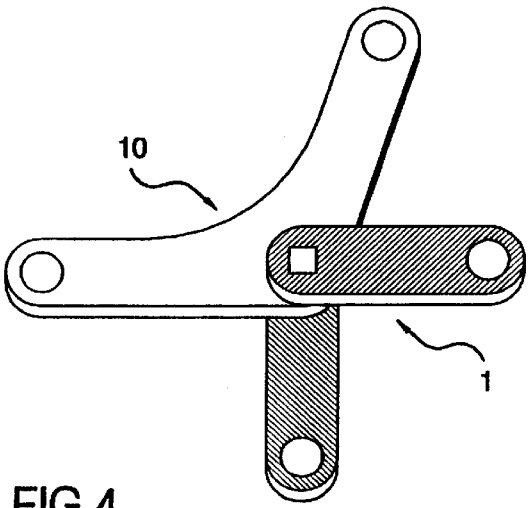
Figure 5:
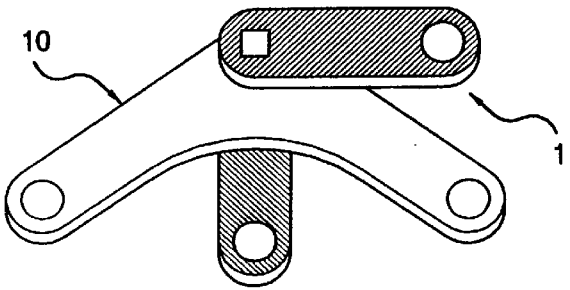
Figure 9:
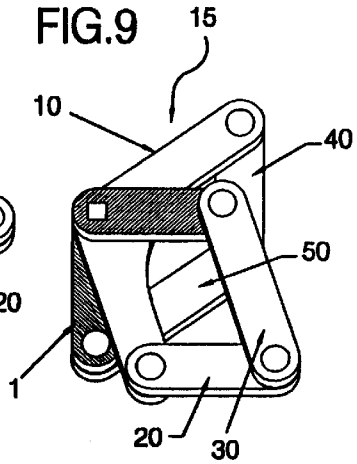
FIGS. 8–12 show other positions of the linkage.
Figure 8:
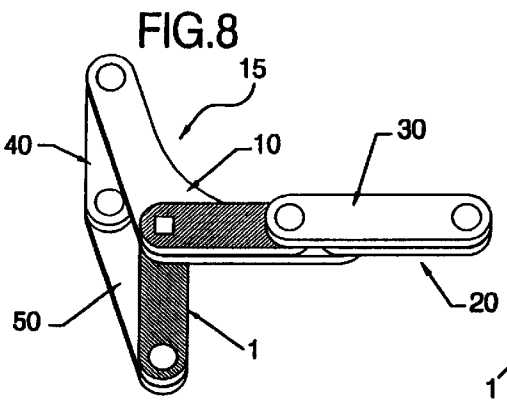

FIG. 3 is an exploded view of link 1 with a second angulated link 10 lying between sub-links 2 and 3. Link 10 has a central pivot 11 and two terminal pivots 12 and 13. Link 10 may be pivotally attached to link 1 such that central pivot 11 is engaged with pivot 5. Link 10 and others of its general type are hereinafter referred to as planar links. FIG. 4 shows multi-level 1 and planar link 10 pivotally attached together. Link 1 is shown as a shaded element for clarity in the drawing. FIG. 5 shows links 1 and 10 rotated to a different position. It is seen that link 10 is capable of being rotated in a continuous fashion relative to link 1.

Figure 6:
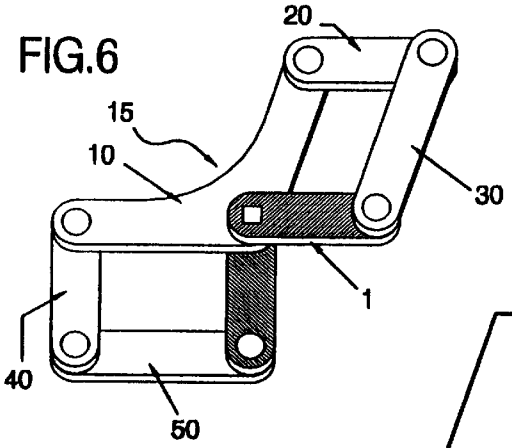
FIG. 6 shows a first embodiment of the invention, a linkage consisting of two parallel assemblies capable of continuous rotation.
Figure 10:
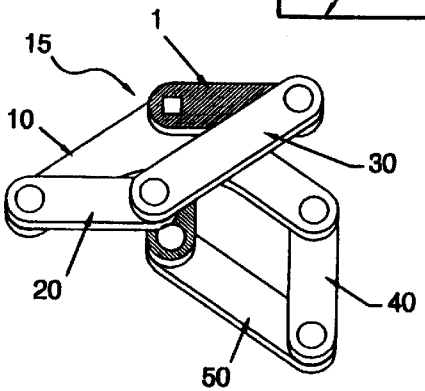

FIG. 6 shows a linkage 15 consisting of multi-level link 1, planar link 10 and four other planar links 20, 30, 40 and 50. Links 20 and 30 are attached to one terminal pivot each of links 1 and 10, and are pivotally attached to each other, thereby forming a closed loop. Similarly links 40 and 50 are attached to one terminal pivot each of links 1 and 10, and are pivotally attached to each other, also forming a closed loop.

Figure 12:
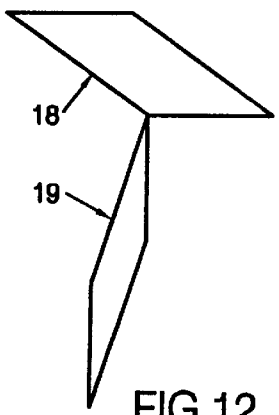
Figure 11:
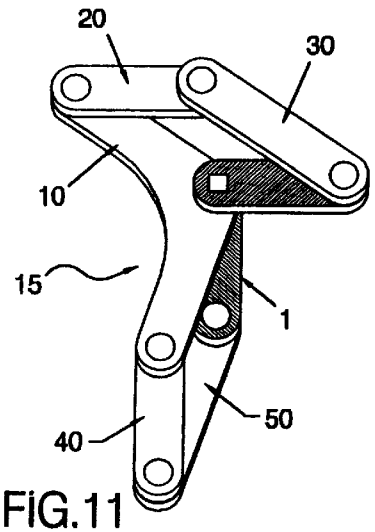
Figure 7:
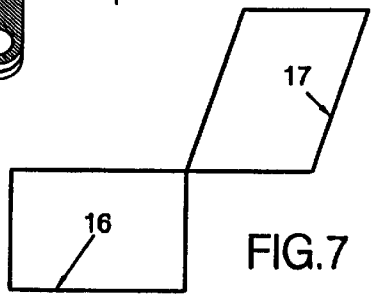
FIG. 7 is a diagram of lines corresponding to the linkage.

FIG. 7 is a diagram of lines that connect pivots-centers of linkage 15 as shown in FIG. 6. The diagram may be seen to consist of two parallelograms 16 and 17. The parallelograms are seen to correspond to parallel four-bar linkages in the actual mechanism. FIGS. 8–11 show linkage 15 in various positions. It is seen that link 10 may be rotated a full 360 degrees relative to link 1 with no interference from attached links 20, 30, 40 and 50. FIG. 12 is a diagram that corresponds to lines connecting the pivots of linkage 15 as shown in FIG. 11. It is seen to consist of two quadrilaterals 18 and 19 which are parallelograms in this case. In fact, for all positions of linkage 15 similarly constructed diagrams consist of two quadrilaterals, with link 10 forming a side of each of the quadrilaterals and a vertex of each quadrilateral. The arms of link 10 have been illustrated as extending at an obtuse angle with respect to each other. It is to be understood that link 10 would function the same if the arms were disposed at acute or right angles. Simarlary, sub-links 2 and 3 of link 1 can also be disposed at other than right angles with respect to each other.

Figures 13, 14, 15, 16, 17, 18, 19, 20:
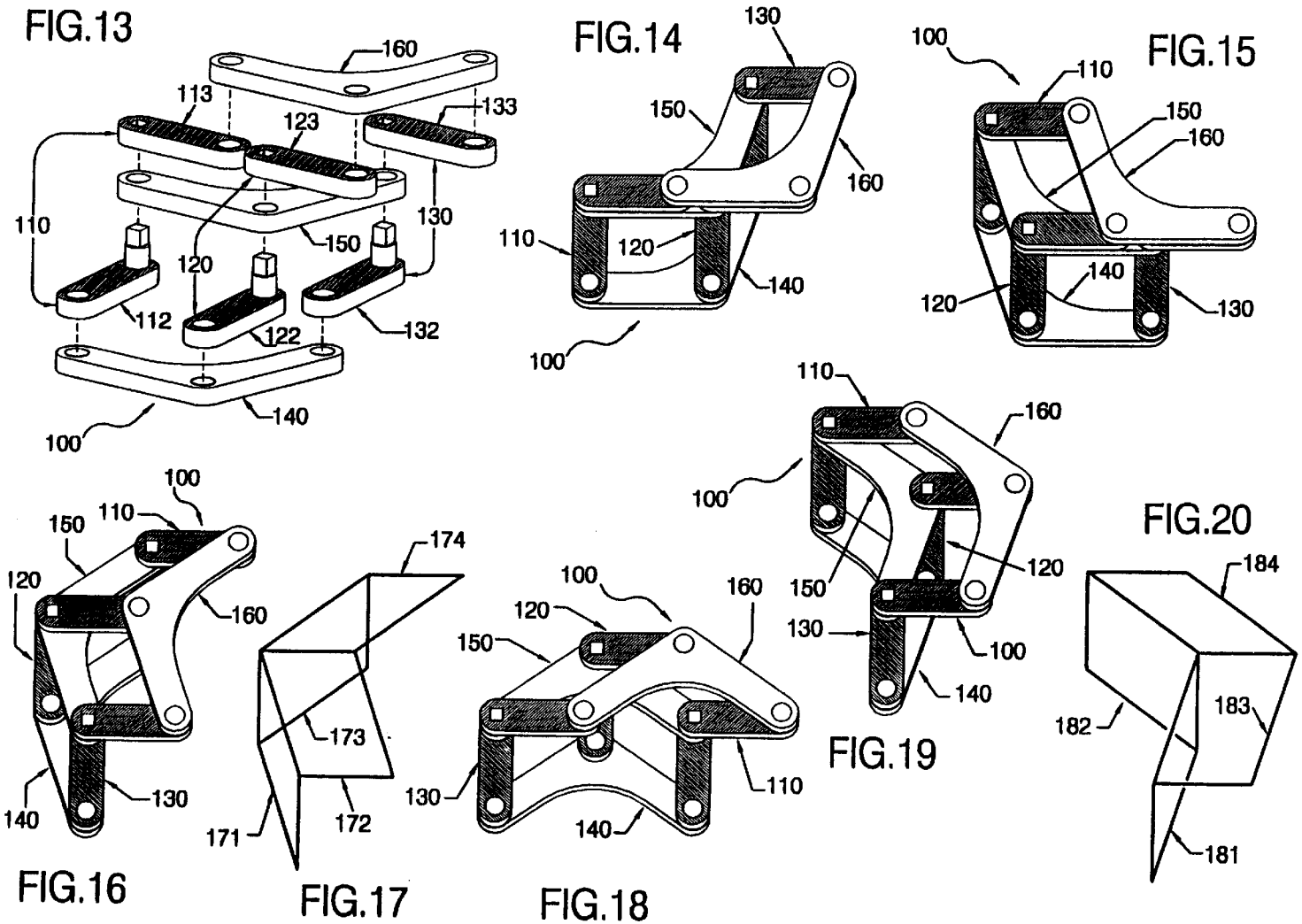
FIG. 13 is an exploded view of a second embodiment of the invention, a linkage having elements on five levels.
FIGS. 14–20 show other positions of the linkage of FIG. 13.

FIG. 13 is an exploded view of linkage which is comprised of three multi-level links, 110, 120 and 130 and three angulated planar links 140, 150, 160. Each central pivot of each multi-level link passes through a pivot of planar link 150, such that sub-links 112, 122 and 132 lie on one side of planar link 150 and sub-links 113, 123 and 133 lie on the other side of link 150. Planar link 140 is pivotally attached to one terminal pivot each of multi-level level links 110, 120 and 130. Likewise, planar link 160 is pivotally attached to one terminal pivot each of multi-level level links 110, 120 and 130.

FIG. 14 shows linkage 100 in assembled form. Each central pivot of multi-level links 110, 120 and 130 passes through and has a pivotal connection with planar link 150. Sub-links 112 and 113 are rigidly attached together to form multi-level link 110. Similarly sub-links 122, 123 and sub-links 132, 133 form multi-level links 120 and 130 respectively. FIG. 15 shows linkage 100 in a different position where planar link 150 has been rotated relative to multi-level link 120. FIG. 16 shows another rotational position of linkage 100. FIG. 17 is a diagram that corresponds to the lines connecting the pivots of linkage 100 as shown in FIG. 15. It is seen to consist of four quadrilaterals (parallelograms) 171, 172, 173 and 174. Links 140, 150 and 160 form a side and vertex of adjacent quadrilaterals. FIGS. 18 and 19 show other positions of linkage 100. Examining the five positions shown in FIGS. 14–19, it is seen that the rotation of planar link 150 relative to multi-level link 120 continues without interference through a complete 360 degree revolution. FIG. 20 is a diagram that corresponds to lines connecting the pivots of linkage 100 as shown in FIG. 19. It is seen to consist of four parallelograms 181, 182, 183 and 184. In fact, for all positions of linkage 100 similarly constructed diagrams are seen to consist of four parallelograms.

FIG. 21 is an exploded view of a linkage 200, which consists of two planar links 210 and 211, as well as two multi-level links 220 and 230. Multi-level link 220 is comprised of two sub-links 221 and 222, and lies on either side of planar link 210; multi-level link 230 is comprised of sub-links 231 and 232 and lies on either side on planar link 211. Also shown is FIG. 21 is yoke-like link 260 which spans the full thickness of linkage 200 and is pivotally attached to links 220 and 230. Link 260 is shown in two exploded parts for clarity in the drawings. Additionally, link 260 is pivotally attached to links 240 and 250 which serve to synchronize the motion of linkage 200. Also shown are knobs 241, 251 which are used to drive the linkage. Knobs 241, 251 are connected to links 240, 250 by means of a multi-level link, which rotatably couples links 240, 250 to link 260 and rigidly couples links 240, 250 to links 241, 251. As is shown in FIG. 22, yoke 260 may include a handle portion 261 having an opening 262 (or other means) for attachment to an external object such as a key ring.

FIG. 22 is a side view of linkage 200. Link 260 spans the full width of linkage 200. Hereinafter links of the same type as 260 shall be referred to as spanning links. FIG. 23 is a front view of linkage 200. FIG. 24 is a front view of linkage 200 in a different position. FIG. 25 shows a diagram of lines that correspond to the pivots of linkage 200. The diagram is seen to consist of three parallelograms 270, 271 and 272. FIG. 25 shows a front view of linkage 200 in yet another position. FIGS. 27, 28 and 29 are perspective views of linkage 200 in three positions corresponding to the front views 23, 24 and 26 respectively. As can be seen in FIG. 21, certain link elements such as elements 240, 250 are V-shaped and have arms which are not linked to another element. Such arms add to the appearance of the overall device, but are not strictly needed for functionality. Similarly, each side of yoke element 260 is shown as X-shaped, but could also take various other configurations depending on aesthetic or functional requirements.

Figures 30, 31, 32, 33, 34, 35, 36, 37, 38:
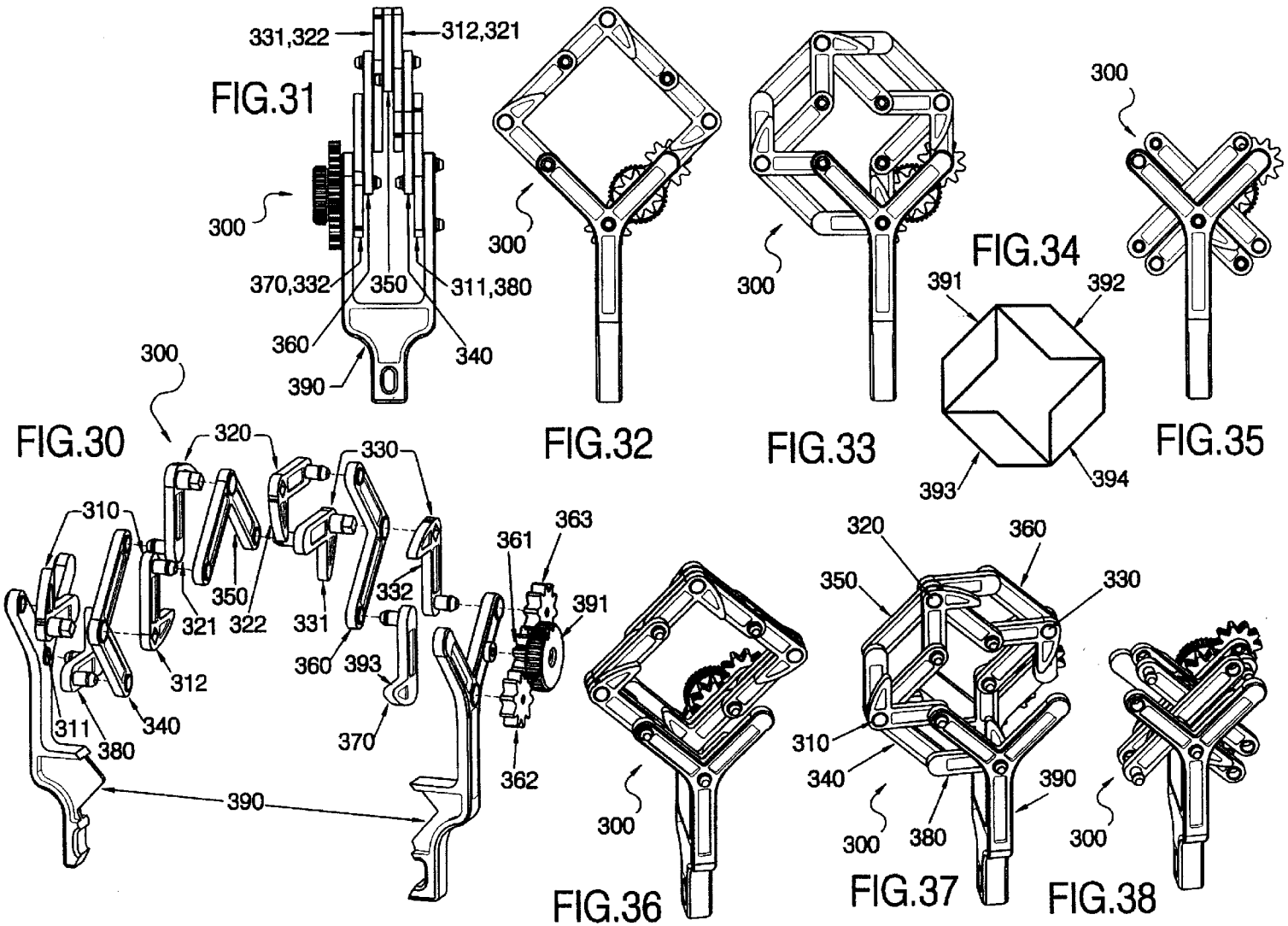
FIG. 30 is an exploded view of a fourth embodiment of the invention having one link that spans the full thickness of the linkage.
FIG. 31 shows a side view of the linkage of FIG. 30.
FIGS. 32–35 show front views of the linkage of FIG. 30 in different positions.
FIGS. 36–38 show perspective views of the linkage of FIG. 30 in different positions.

FIG. 30 shows an exploded view of a linkage 300 which consists of three planar links 340, 350 and 360, as well as three multi-level links 310, 320 and 330. Multi-level link 310 is comprised of two sub-links 311 and 312, and lies on either side of planar link 340; multi-level link 320 is comprised of sub-links 321 and 322 and lies on either side on planar link 350; multi-level link 330 is comprised of sub-lines 331 and 332 and lies on either side on planar link 360. Also shown in FIG. 30 is a Y-shaped yoke link 390 which spans the full thickness of linkage 300 and is pivotally attached to links 310 and 330. Link 390 is shown in two exploded parts for clarity in the drawing. Link 390 is pivotally attached to links 370 and 380 which serve to synchronize the motion of linkage 300. Additionally shown are gear elements 362, 363 which may be rigidly attached to links 370, 332 respectively. Also shown is a third gear 361, which includes a knob 391 and which engages with gears 362, 363. These three gears serve to assist in synchronizing the movement of linkage 300.

FIG. 31 shows a side view of linkage 300. Spanning link 390 is seen to span the full width of linkage 300. FIG. 32 shows a front view of linkage 300. FIG. 33 shows a front view of linkage 300 in a different position. FIG. 34 shows a diagram of lines that correspond to the pivots of linkage 300. The diagram is seen to consist of four parallelograms 391, 392, 393 and 394. FIG. 35 shows a front view of linkage 300 in yet another position. FIGS. 36, 37 and 38 show perspective views of linkage 300 in three positions corresponding to the front views 32, 33 and 35 respectively. The pawl shaped extensions 392, 393 of links such as 330, 370 serve to provide clearance for other link elements during rotation.

Figures 39, 40, 41, 42, 43, 44, 45, 46, 47, 48:
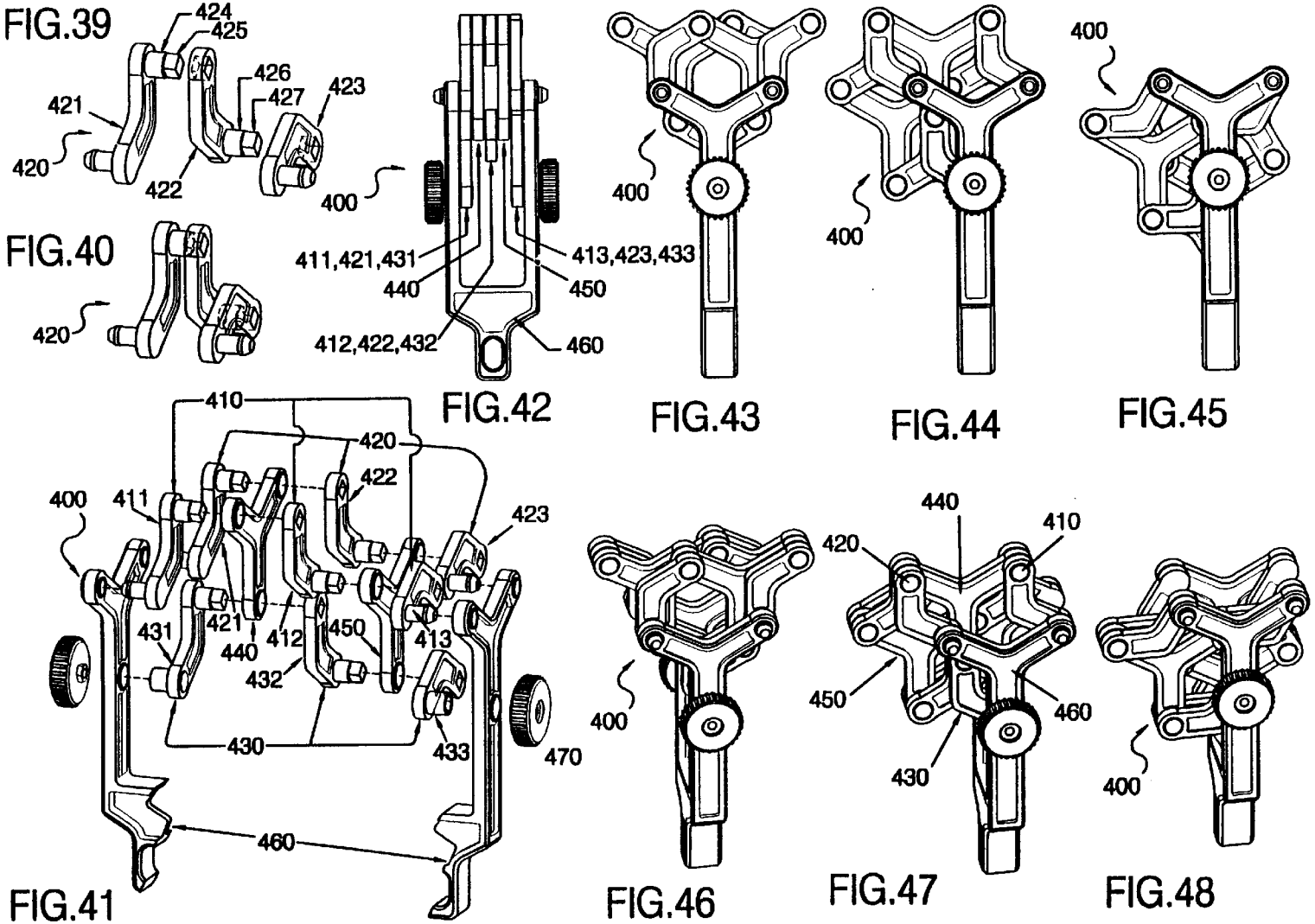
FIGS. 39–40 are an exploded view of a fifth embodiment of the multi-level link of the present invention consisting of three sub-links lying on three levels.
FIG. 41 shows an exploded view of a fifth embodiment of the invention having one link that spans the full thickness of the linkage.
FIG. 42 is a side view of the linkage of FIG. 41.
FIGS. 43–45 are a front view of the linkage of FIG. 41 in different positions.
FIGS. 46–48 are perspective views of the linkage of FIG. 41 in different positions.

FIG. 39 is an exploded view of a link 420 which is comprised of three sub-links 421, 422 and 423. Sub-link 421 has a pivot 424 to which an element 425 is attached, element 425 provides means to make a rigid connection to sub-link 422. Likewise, sub-link 422 has a pivot 426 to which an element 427 is attached, element 427 providing means to make a rigid connection to sub-link 423. FIG. 40 shows link 420 in its assembled condition. Link 420 is a multi-level link having three distinct levels. FIG. 41 shows an exploded view of linkage 400. It consists of two Y-shaped planar links 440 and 450, as well as three multi-level links 410, 420 and 430. Multi-level link 410 is comprised of three sub-links 411, 412 and 413. Planar link 440 lies between sub-links 411 and 412. Planar link 450 lies between sub-links 412 and 413. In a similar manner multi-level links 420 and 430, comprised of sub-links 421, 422, 423 and 431, 432, 433 respectively, lie on either side of planar links 440 and 450. Also shown in FIG. 41 is a Y-shaped yoke link 460 which spans the full thickness of linkage 400 and is pivotally attached to links 410, 420 and 430.

FIG. 42 shows a side view of linkage 400. Spanning link 460 may be seen to span the full width of linkage 400. FIG. 43 shows a front view of linkage 400. FIG. 44 shows a front view of linkage 400 in a different position. FIG. 45 shows a front view of linkage 400 in yet another position. FIGS. 46, 47 and 48 are perspective views of linkage 400 in three positions corresponding to front views 43, 44 and 45 respectively.

The present invention has been described with respect to preferred embodiments. It is to be understood that modifications and variations to the illustrated structures may be resorted to, by persons skilled in the art, without departing from the scope of the invention, as set forth in the claims to follow.

What is claimed is:

1. A linkage comprising at least six links and at least seven pivot connections, all axes of said pivots being parallel to one another, wherein a diagram of lines connecting the centers of said pivots drawn in a plane orthogonal to the axes of the pivots forms at least two parallelograms such that each parallelogram shares at least one vertex with another parallelogram, wherein each parallelogram corresponds to a parallel four-bar linkage, and each shared vertex in the diagram corresponds to a pivot connection between at least two links, each of which links has one or more central pivots and two or more terminal pivots, and of these two or more links at least one lies essentially in one plane, and at least one other link is comprised of at least two sub-links, such that each sub-link lies on a different level, where at least one sub-link lies on one side of the planar link, and at least one other sub-link lies on the opposite side of the planar link, and the pivot connection between the planar and multi-level link is constructed such that the central pivot of the planar link is essentially a hole through which a pin comprising the central pivot of the multi-level link passes, and said pin:

a) forms the pivot connection between the planar link and the multi-level link; and b) rigidly connects at least two sub-links of the multi-level link to one another; such that said planar link and said multi-level link may rotate around their shared pivot connection relative to each other a full 360 degrees, to thereby driving the interconnected four-bar linkages in a continuous fashion.

2. A linkage according to claim 1, such that a diagram of lines formed as described above is comprised of at least three parallelograms that form a closed loop in all positions.

3. A linkage according to claim 2 such that at least one link brackets the full thickness of the linkage, having one or more pivot connections with those links lying in the outermost planes of the linkage.

4. A linkage according to claim 1, wherein gears are attached to at least two links in order to synchronize the motion of the linkage.

5. A linkage system forming at least two continuously rotatable quadrilaterals, said system comprising;

(a) a link element having first and second sub-links, each of said first and second sub-links including a terminal pivot, said first and second sub-links forming a first side of said first quadrilateral and a first side of said second quadrilateral;

(b) a multi-level linkage element non-rotatably joining said first and second sub-links of said link element, such that said first and second sub-links are joined at a predetermined angle and are disposed in separate parallel planes, said multi-level linkage element further including means to rotatably couple a planar link element between said first and second sub-links;

(c) a planar link element rotatably coupled to said rotatable coupling means of said multi-layer linkage, said planar link having first and second arms disposed at a predetermined angle to each other, said first and second arms of said planar link including terminal pivots, said planar link element forming the second side of said first and second quadrilaterals;

(d) the third and fourth sides of said first quadrilateral being formed by two linkage elements, said two linkage elements being rotatably joined to a terminal pivot of said planar link, a terminal pivot of said first sub-link and to each other;

(e) the third and fourth sides of said second quadrilateral being formed by two linkage elements rotatably joined to a terminal pivot of said planar link, a terminal pivot of said second sub-link and to each other; and (f) wherein said first and second quadrilaterals lie in separate planes so that they are continuously rotatable with respect to each other.

6. The linkage system as claimed in claim 5 wherein the arms of the planar link are disposed at an obtuse angle to each other.

7. The linkage system as claimed in claim 5 wherein said first and second sub-links are disposed at right angles to each other.

8. The linkage system as claimed in claim 5 further including second and third planar sub-links and said second and third link elements having non-rotatably joined first and second sub-links so as to form four rotatable quadrilaterals.

9. The linkage system as claimed in claim 5 further including a plurality of planar and multi-level links which are interconnected so as to rotate sychronously.

10. The linkage system as claimed in claim 5 further including a yoke link, spanning the width of the linkage system and rotatably connected thereto, said yoke link being sized and constructed to permit the linkage system to be rotated within the yoke.

11. The linkage system as claimed in claim 10 further including a knob disposed externally of said yoke link and rotatably connected thereto, said knob being non-rotatably connected to said linkage system to permit said linkage system to be rotated when said knob is turned.

12. The linkage system as claimed in claim 5 further including first and second gears connected to said linkage systems to permit said linkage system to be rotated synchronously.

13. A toy comprising:

(a) a linkage system, said linkage system comprised of link elements forming at least first and second quadrilaterals, said first and second quadrilaterals having first and second common sides and a common vertex, said first and second quadrilaterals lying in separate parallel planes and being continuously rotatable with respect to each other;

(b) a yoke spanning said linkage system, said linkage system being rotatably mounted within said yoke; and (c) a knob rotatably mounted to said yoke and coupled to said linkage system to rotate said linkage system as said knob is turned.

14. The toy as claimed in claim 13 further including first and second gears rotatably mounted to said yoke, said first and second gears being coupled to first and second link elements of said linkage system so as to cause said linkage system to rotate synchronously.

15. The toy as claimed in claim 13 wherein said linkage system includes link elements forming at least four continuously rotatable quadrilaterals.

16. The toy as claimed in claim 13 wherein said yoke is X-shaped.

17. The toy as claimed in claim 13 wherein said yoke is Y-shaped.

* * * * *